United States Patent [19]

Nakatani

[11] Patent Number: 4,742,373

[45] Date of Patent: May 3, 1988

[54] COPYING MACHINE

[75] Inventor: Keiji Nakatani, Toyokawa, Japan

[73] Assignee: Minolta Camera Kabushiki Kaisha, Osaka, Japan

[21] Appl. No.: 59,843

[22] Filed: Jun. 9, 1987

[30] Foreign Application Priority Data

Jun. 12, 1986 [JP] Japan ..... 61-137144
Jun. 16, 1986 [JP] Japan ..... 61-139466

[51] Int. Cl.[4] ..... G03G 15/04

[52] U.S. Cl. ..... 355/14 R; 355/7; 355/40

[58] Field of Search ..... 355/7, 14 R, 3 R, 40–43

[56] References Cited

U.S. PATENT DOCUMENTS

| | | | |
|---|---|---|---|
| 4,215,929 | 8/1980 | Sato et al. | 355/7 |
| 4,256,400 | 7/1981 | Komori et al. | 355/7 X |
| 4,291,341 | 9/1981 | Yajima | 355/14 C |
| 4,346,982 | 9/1982 | Nakajima et al. | 355/7 X |
| 4,417,805 | 11/1983 | Kishi | 355/7 X |
| 4,582,417 | 4/1986 | Yagasaki et al. | 355/7 |
| 4,627,707 | 12/1986 | Tani et al. | 355/14 R |
| 4,631,599 | 12/1986 | Cawkell | 355/7 X |
| 4,637,707 | 1/1987 | Kasahara et al. | 355/7 X |
| 4,653,899 | 3/1987 | Watanabe | 355/14 R |
| 4,692,021 | 9/1987 | Watanabe | 355/7 X |

*Primary Examiner*—R. L. Moses
*Attorney, Agent, or Firm*—Burns, Doane, Swecker & Mathis

[57] ABSTRACT

A copying machine is capable of making a portion of a copy corresponding to a specific area of a document highlightened, more specifically, capable of giving suitable contrasts among areas of the copy corresponding to the areas of the document, when those areas have different degrees of importance, and capable of forming characters on a copying paper readily without an input device, such as a word processor keyboard which requires significant modifications on the copying system.

13 Claims, 10 Drawing Sheets

COPYING MACHINE

BACKGROUND OF THE INVENTION

1. Field of the Invention

The present invention relates to a copying machine employing an electrophotographic process and, more particularly, to a copying machine capable of edit-copying.

2. Description of the Prior Art

There has been proposed an electrophotographic copying machine capable of so-called edit-copying function for forming a blank area, corresponding to a specific area on a document, on a copying paper.

Such a conventional electrophotographic copying machine having edit-copying function is based on a principle of omitting the reproduction of an area undesired to be copied or an area to be blanked in a document by eliminating electric changes in the area on the photosensitive member corresponding to the undesired area to be copied or the area to be blanked in the document prior to developing the electrostatic latent image, thus the toner attraction to the area on the photosensitive member is prohibited.

However, such a conventional copying machine does not fulfil the following two requirements.

When copies of a document are to be distributed, a portion of a copy corresponding to a specific area of the document should be highlightened. For that purpose, it is a usual practice to underline the part on the document or on the copies.

Further, copying machines are recently required to print simple data such as date in addition to the image of a document. In such a case, it is a usual practice to enter a desired data on the document before copying the same or to enter the desired data on the copies of the document.

Writing data or underlining on the document spoils the document while writing data or underlining on copies requires much labor when many copies of the document are needed.

Therefore, such a copying machine is required to be capable of making a portion of a copy corresponding to a specific area of the document highlightened without sufferring from said drawbacks, more specifically, capable of giving suitable contrasts among areas of the copy corresponding to the areas of the document, when those areas have different degrees of importance.

It is also required to introduce a copying machine capable of forming characters on a copying paper readily without an input device, such as a word processor keyboard which requires significant modifications on the copying system.

SUMMARY OF THE INVENTION

Accordingly, an object of the present invention is to provide a copying machine capable of giving suitable contrasts among areas of a copy corresponding to the desired areas of the document.

Another object of the present invention is to provide a copying machine capable of generating characters and entering the same on a copying paper without an input device requiring significant modifications on the copying system.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The present invention will be described hereinafter with reference to a preferred embodiment thereof illustrated in the accompanying drawings.

Figure 1:
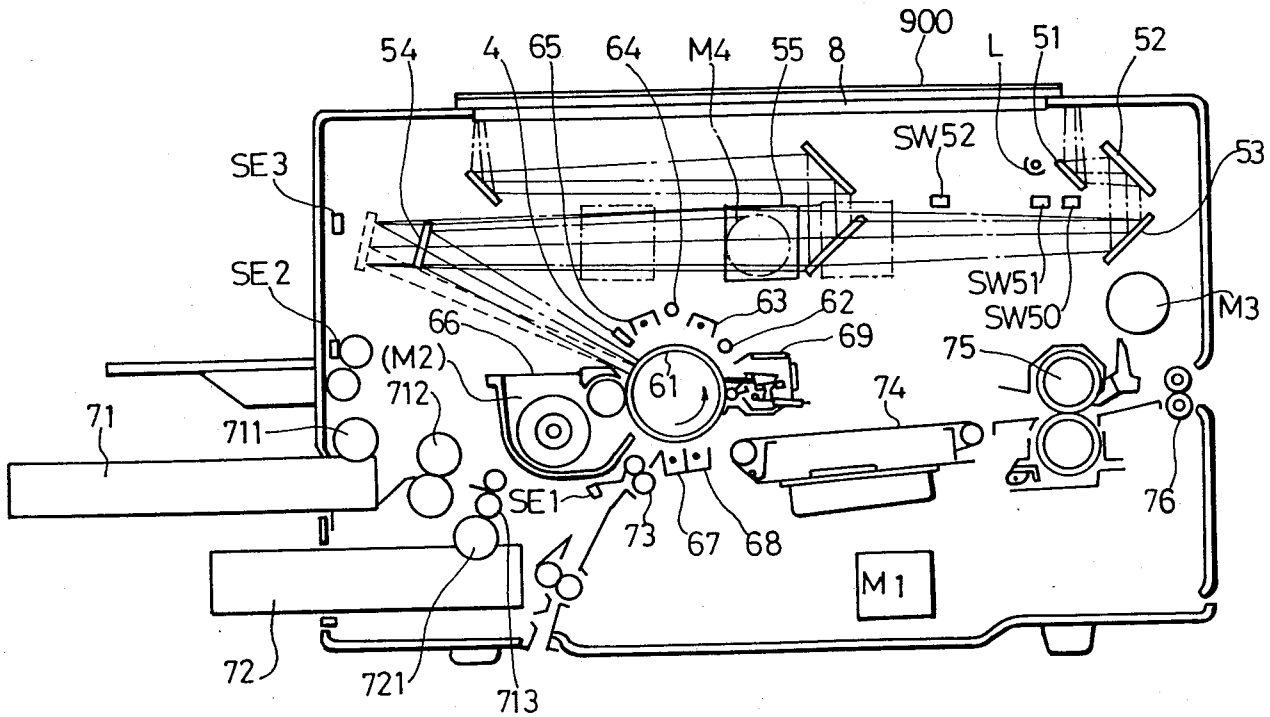
FIG. 1 is a schematic sectional side elevation view showing the general construction of a copying machine in a preferred embodiment according to the present invention.

FIG. 1 is a schematic sectional view showing the construction of a copying machine embodying the present invention.

Referring to FIG. 1, the copying machine comprises an optical system 5 (51 to 55) which performs optical scanning of a document on a contact table 8, an image forming system 6 (61 to 69) which reproduces the image of the document through electrophotographic processes, a sheet transfer system 7 (71 to 76) which feeds and conveys copying paper and fixes the image on the copying paper and an editor 900 for editing the copied image.

(a) Optical System:

The optical system 5 comprises a light source L, mirrors 51, 52, 53 and 54, a lens block 55, and a driving mechanism, not shown. The movable members of the optical system reciprocate along the lower surface of the contact table 8 for optical scanning operation. During the scanning travel, the optical system scans a document placed on the contact table 8 optically. Light reflected from the document is reflected repeatedly in the mirrors 51, 52 and 53, is travelled through the lens block 55 (variable magnification lens block), is reflected from the mirror 54, and then is focused on a photosensitive drum 61. The mirrors 51, 52 and 53 are interlocked with each other and are driven by a scanning motor M3. The travelling speed of the mirror 51 is v/m and the travelling speed of the mirrors 52 and 53 is v/2m to make an optical path length constant, where v is the circumferential speed of the photosensitive drum, and m is a copying magnification. The mirror 54 and the lens block 55 are interlocked with each other and are driven by a magnification setting motor M4. The lens block 55 is moved along the optical axis to change copying magnification, and the mirror 54 is moved and turned to correct the focal point.

(b) Image forming system:

The image forming system 6 comprises the photosensitive drum 61 which is rotatable in a direction indicated by an arrow, and a main eraser lamp 62, an auxiliary charger 63, an auxiliary eraser lamp 64 a main charger 65, a developing unit 66, a transfer charger 67, a sheet separating charger 68, and a blade type cleaning unit 69, which are arranged around the photosensitive drum 61. The latent image eraser 4, which will be described later, is disposed adjacent to the circumference of the photosensitive drum 61 between the main charger 65 and the developing unit 66. In this embodiment, the latent image eraser 4 is disposed on the side of the main charger 65 with respect to an exposure position where the reflex light is focused on the photosensitive drum 61, however, the eraser 4 may be disposed on the side of the developing unit 66 with respect to the exposure position.

A photosensitive layer is formed over the surface of the photosensitive drum 61. The photosensitive layer is sensitized and charged by the auxiliary charger 63 and the main charger 65, and then is subjected to slit exposure to form the electrostatic latent image corresponding to the image of the document. In this embodiment, the charges on the particular areas on the photosensitive layer corresponding to designated areas of a document are reduced by the latent image eraser 4 prior to the slit exposure. Accordingly, an electrostatic latent image corresponding to the reduced electric potential is formed on the particular areas on the photosensitive layer. The full erasing thereby the latent image of the area is completely eliminated, can also be performed by reducing the electric potential to a certain degree. In the case where characters are to be entered onto a copying paper, the charges of the areas are reduced on the basis of font patterns in the same manner.

The electrostatic latent image is developed to a toner image by attracting toners in the developing unit 66, and then the toner image is transferred by the transfer charger 67 to a copying paper fed by the timing roller 73 of the sheet transfer system 7.

(c) Sheet Transfer System:

The sheet transfer system 7 comprises an upper sheet cassette 71, a lower sheet cassette 72, a pair of feed rollers 711 and 721 associated with the upper sheet cassette 71 and the lower sheet cassette 72, respectively, two pairs of conveyor rollers 712 and 713 associated with the upper sheet cassette 71 and the lower sheet cassette 72, respectively, a pair of timing roller 73, a conveyor belt 74, a fixing unit 75, a pair of discharge rollers 76, and a main motor M1 for driving the foregoing components. The toner image transferred to the copying paper is heat-fixed by the fixing rollers of the fixing unit 75.

Figure 2:
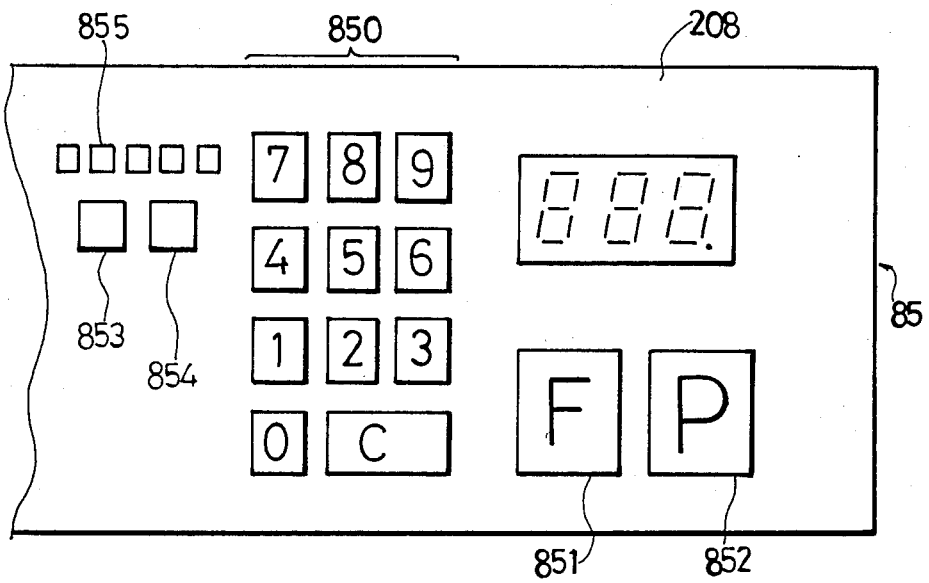
FIG. 2 is a plan view of a control panel of the copying machine of FIG. 1.

(d) Control Panel:

As partly shown in FIG. 2, the control panel 85 is located on the front side of the contact table 8, and is provided with the ten-key pad 850, a print key 852, a function key 851, image density setting keys 853 and 854, a numerical value display panel 208 and a density display panel 855.

To enter the desired image density for designated areas of a document, the function key 851 is pressed and then a desired numerical value is entered with the ten-key pad 850. In this instance, the image density means the light intensity corresponding to the electric potential on the photosensitive drum to be reduced.

On the other hand, in case the ten-key pad 850 are pressed before pressing the function key 851, the number of copies to be reproduced is entered in the same manner as in conventional copying machines.

Figure 3:
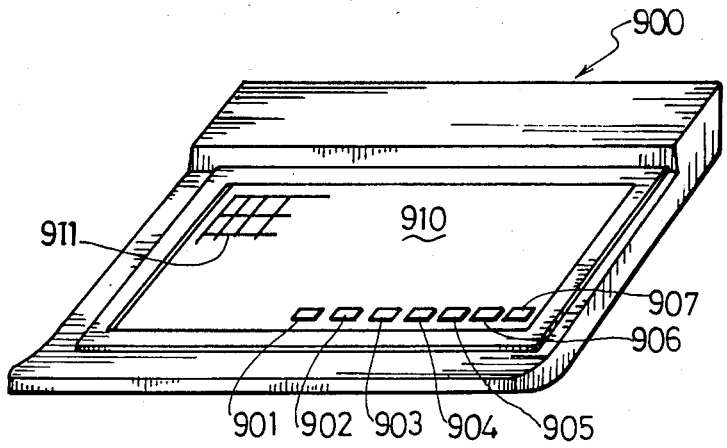
FIG. 3 is a perspective view of an editor to be connected to the copying machine.

(e) Editor:

FIG. 3 is a perspective view of the editor 900. In this embodiment, the editor 900 is disposed on the contact table 8 as shown in FIG. 1.

Referring to FIG. 3, the editor 900 has a tablet 910 and keys 901 to 907. The tablet 910 has a plurality of resistance wires 911 disposed in lines and rows along the directions of x-axis and y-axis at intervals of approximately 1 mm. A desired point on the tablet 910 is depressed to short-circuit the resistance wires at the point, then a resistance value corresponding the coordinates (x, y) of the point is detected in a voltage level. Accordingly, in entering the coordinates (x, y) of a particular point in a document, the document is forcibly placed on the tablet 910 at a predetermined position, and then the particular point is depressed. Numericals 1, 2, . . . and characters A, B, C, . . . are printed on the tablet 910. In entering the numerals or the characters, the printed numerals or the printed characters are depressed after depressing a character key 905, which will be described later.

Keys 901 to 907 are an erase key, a trimming key, a half key, a clear key, the character key, an end key and an all clear key, respectively. The erase key 901 is used for designating the full erasing of a designated area, the trimming key 902 is for designating the full erasing of an area outside the designated area. The half key 903 is for designating the half erasing of the designated area or the area outside the designated area. The clear key 904 is for deleting a data, stored in a RAM 23 (shown in FIG. 6), regarding a designated area to be erased and the erasing level. The character key 905 is for designating character input mode. The end key 906 is for ending off designating the area and the erasing level. The all clear key 907 is for deleting all data, stored in the RAM 23, for cancelling the designation stated above.

Figure 4:
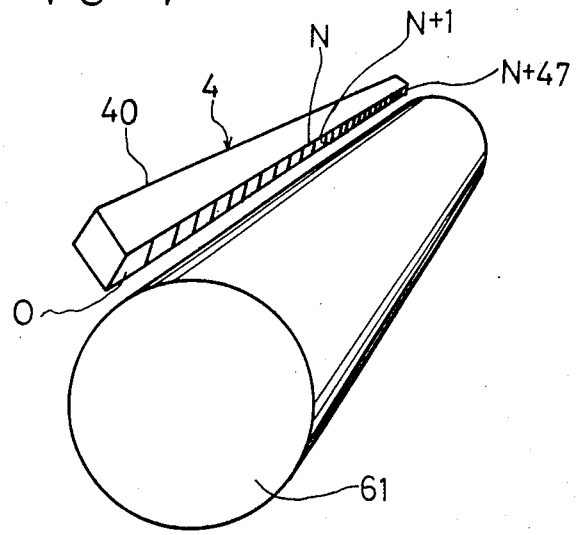
FIG. 4 is a perspective view of an latent image eraser disposed adjacent to the circumference of a photosensitive drum.
Figure 5:
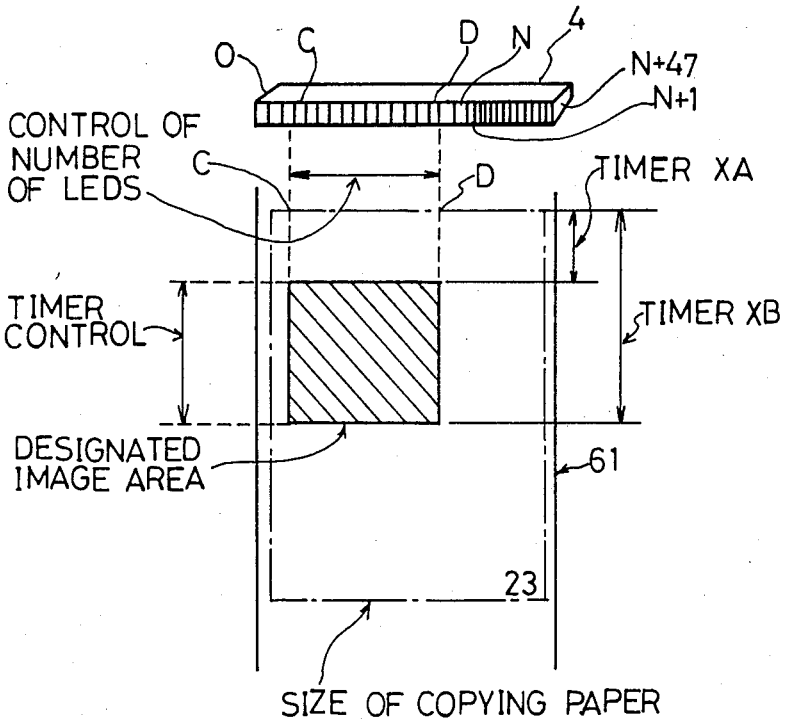
FIG. 5 is a diagrammatic illustration of assistance in explaining the manner of fully erasing or half erasing charges of a designated area with the latent image eraser and entering characters.

(f) Latent Image Eraser:

FIG. 4 is a perspective view of the latent image eraser 4 disposed adjacent to the photosensitive drum 61 and FIG. 5 is a diagrammatic illustration of assistance in explaining the manner of fully erasing or half erasing the charges of a particular area with the latent image eraser 4, and the manner of entering characters.

The latent image eraser 4 has a LED array 40 having N+1 pieces of larger LED's of 5 mm arranged in a line and 47 pieces of smaller LED's of 1 mm arranged in a line. Desired LED's are selectively turned on in a predetermined light intensity to eliminate the charges, or to reduce the charges by a predetermined electric potential, on the corresponding area of the photosensitive drum 61. Thus the electric potential of the electrostatic latent image on the designated area is reduced by a certain degree, or even reduced to zero and characters are also entered in the predetermined area.

As illustrated in FIG. 5 by way of example, suppose that N+1 pieces of the LED's are designated, from left to right, the LED 0 to LED N, and the LED's from the LED C to the LED D are turned on from the time of timer XA counting up to the time of timer XB counting up. Then, the charges of an area on the photosensitive drum 61 corresponding to a hatched area in FIG. 5 are eliminated or reduced and hence no electrostatic latent image or electrostatic latent image having low electric potential is formed in that area. Numerals, for example, "23", is entered by selectively turning on and off the 47 smaller LED's.

Figure 6:
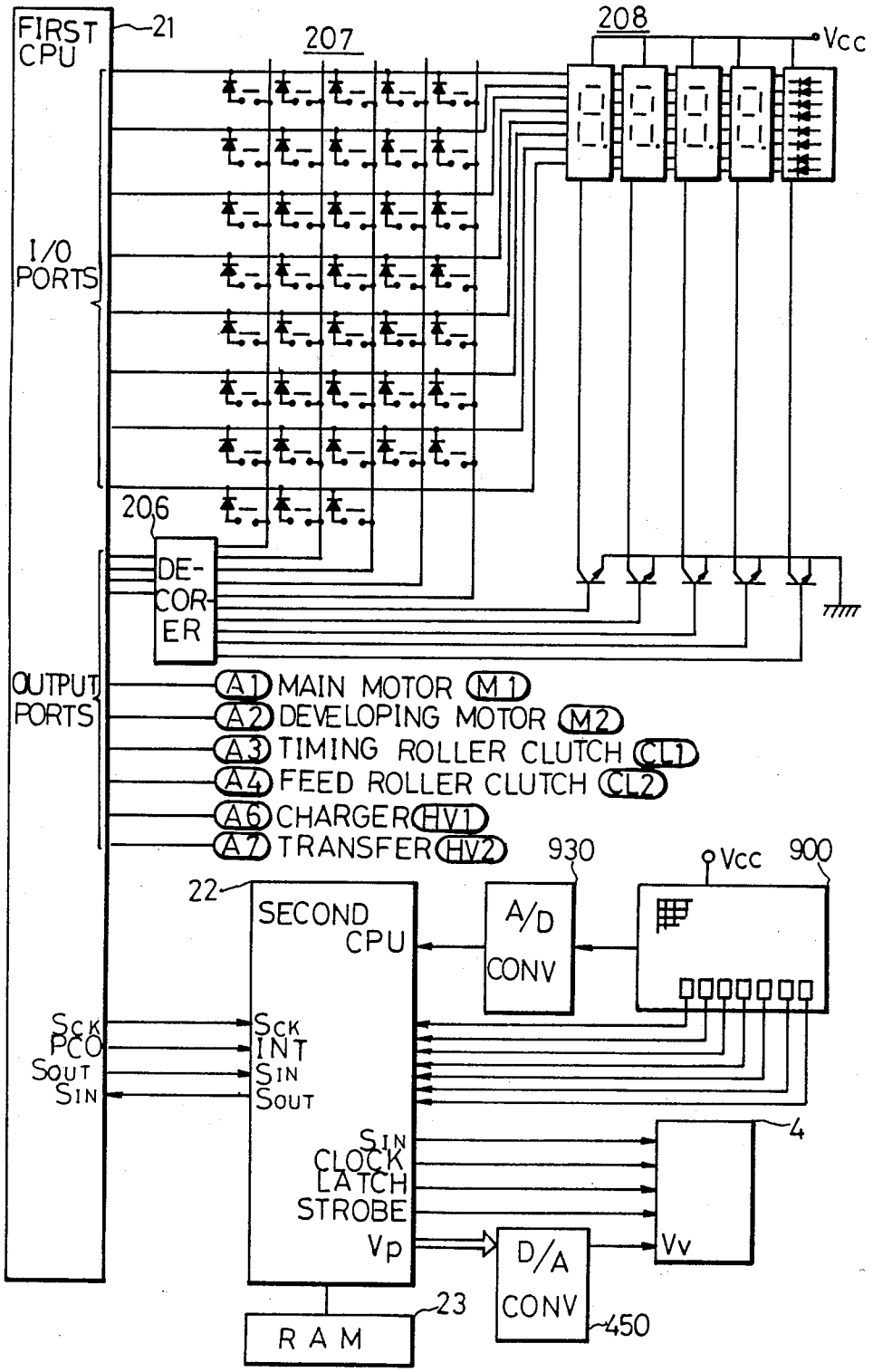
FIG. 6 is a circuit diagram of the control unit of the copying machine of FIG. 1.

(g) Controller:

FIG. 6 shows the electrical constitution of the controller of the copying machine. The controller has a first CPU 21 for controlling the principal operations of the copying machine, and a second CPU 22 for controlling the editor 900 and the latent image eraser 4.

Keys 207 including keys 850 to 854 and a display unit 208 are connected through a decoder 206 to the first CPU 21. Also connected to the first CPU 21 are the main motor M1, a developing motor M2, and drivers for driving a clutch CL1 for regulating the timing rollers 73 rotation, an automatic sheet feed clutch CL2 regulating the feed roller 711 rotation and the feed roller 721 rotation, voltage regulaters for regulating the charger 65 voltage and the transfer charger 67 voltage.

The first CPU 21 controls the principal operations of the copying machine including the operations of the image forming system 6 and the sheet transfer system 7, and other functions including temperature regulation in response to input signals given thereto by means of keys and detection signals given thereto from sensors.

Figure 12:
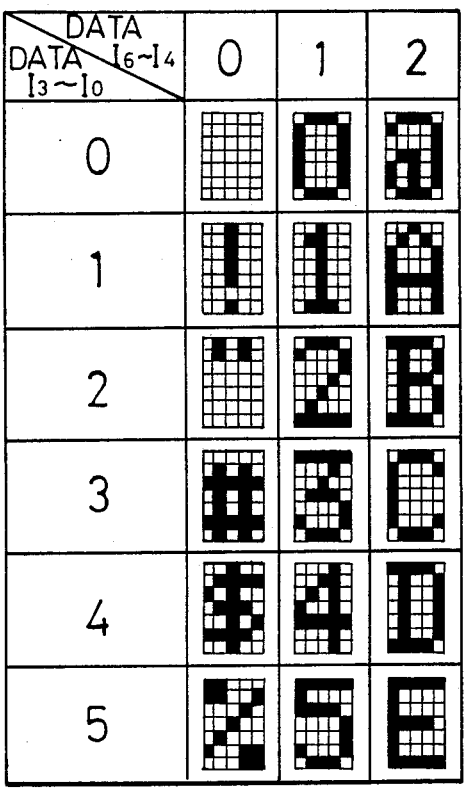
FIG. 12 is an explanatory illustration of a part of font patterns.

The second CPU 22 receives data of coordinate values through an A/D converter 930 from the editor 900. The second CPU 22 also receives signals produced by operating the keys 901 to 907 of the editor 900. Further, the second CPU 22 receives the data regarding the light intensity according to the electric potential to be reduced from the ten-key pad 850 through the first CPU 21. The second CPU 22 starts reading the font patterns (FIG. 12) of designated characters or numerals from the RAM 23 and draws a bit map, in response to the depression of the character key 905 and blocks on the tablet.

The second CPU 22 turns on and off the individual LED's of the latent image eraser 4 in addition to the light intensity control. The control signal for controlling the light intensity of LED is received in the form of analog signal by the voltage regulator 921 (FIG. 7) of the latent image eraser 4 through a D/A converter 450.

In addition to the bit map, the data of coordinate values, the data of light intensity are written in RAM 23.

Figure 7:
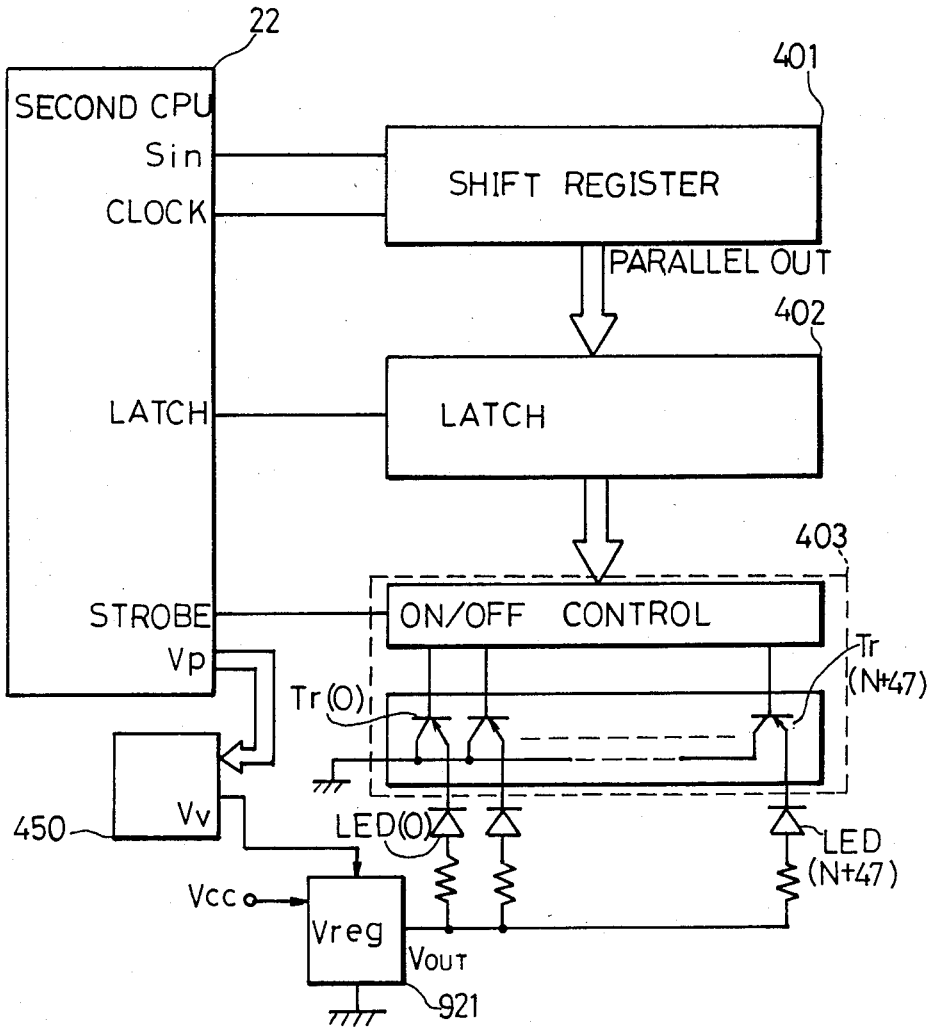
FIG. 7 is a circuit diagram of a driving and controlling circuit of the latent image eraser.
Figure 8:
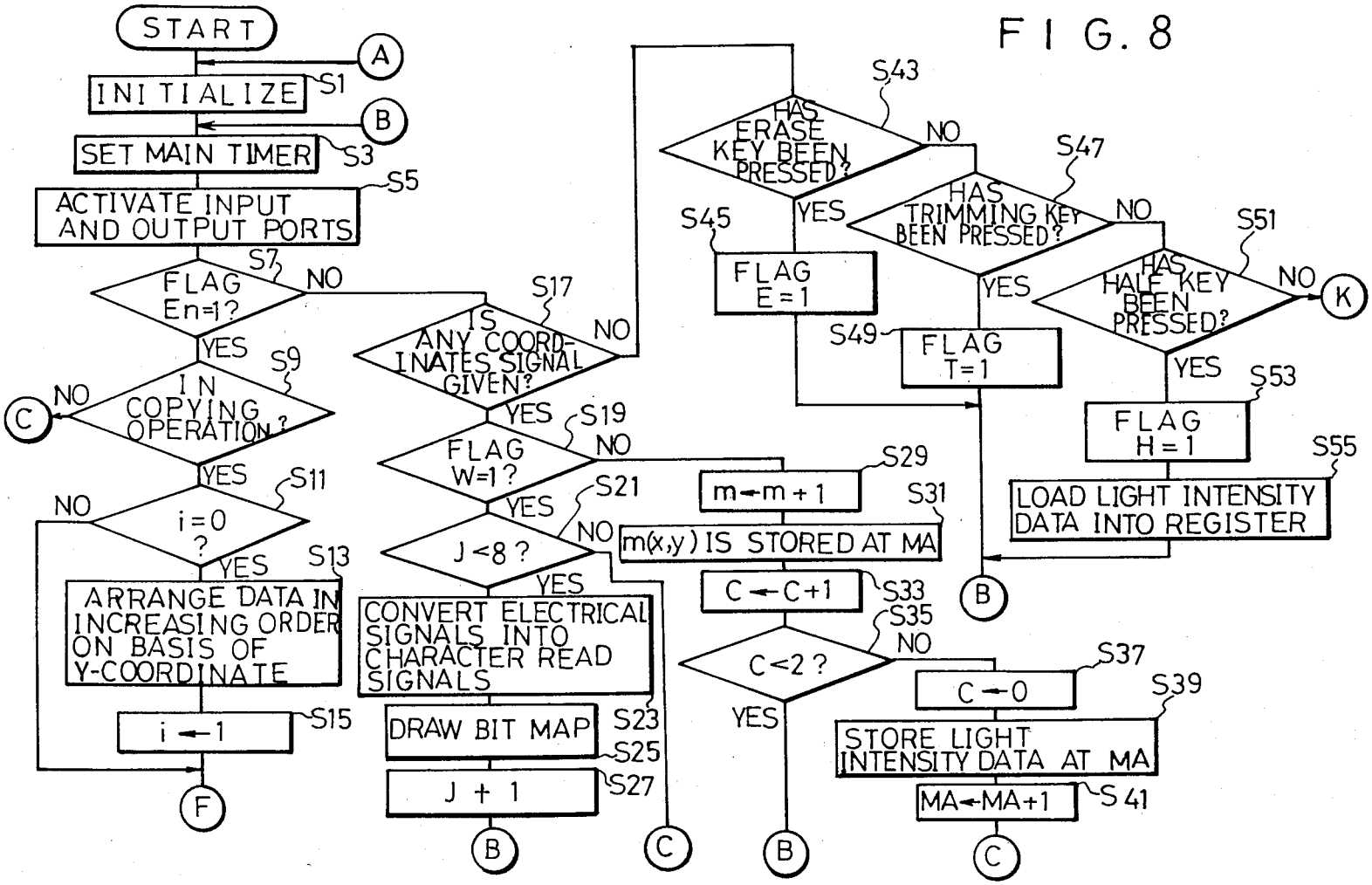
FIGS. 8 to 11 are flow charts of the latent image eraser control programs to be executed by a second CPU.
Figure 9:
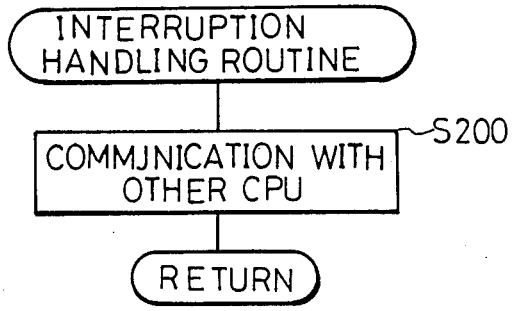
Figure 10:
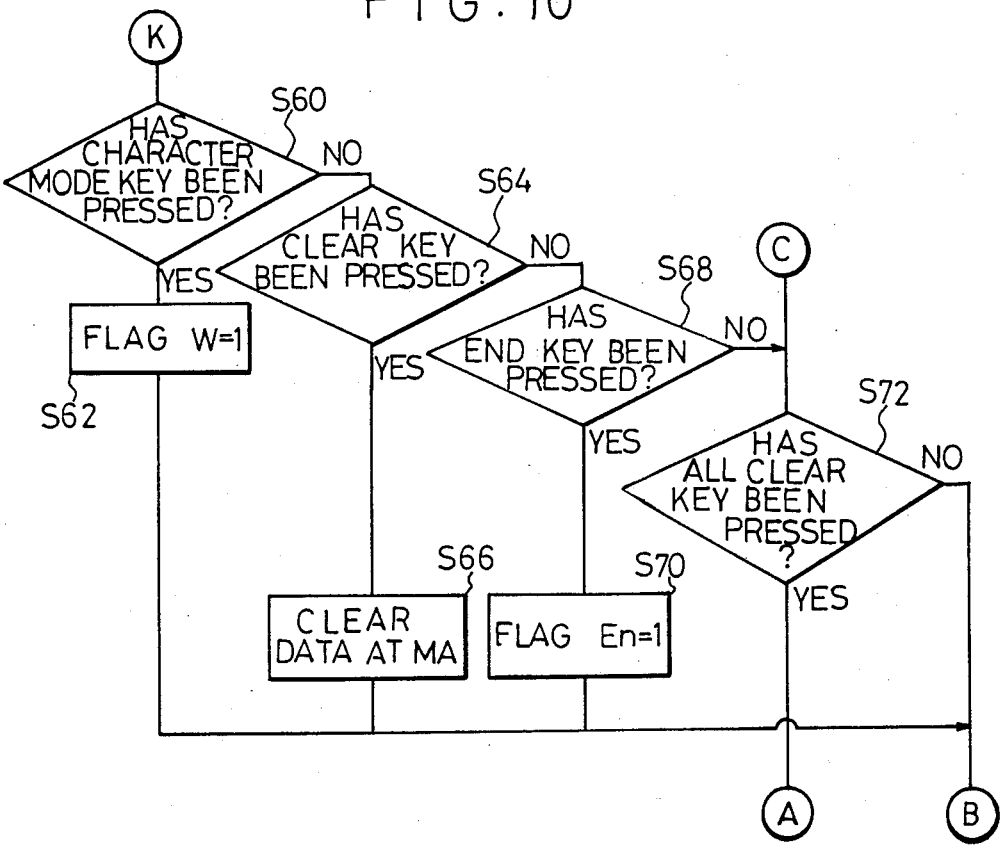
Figure 11:
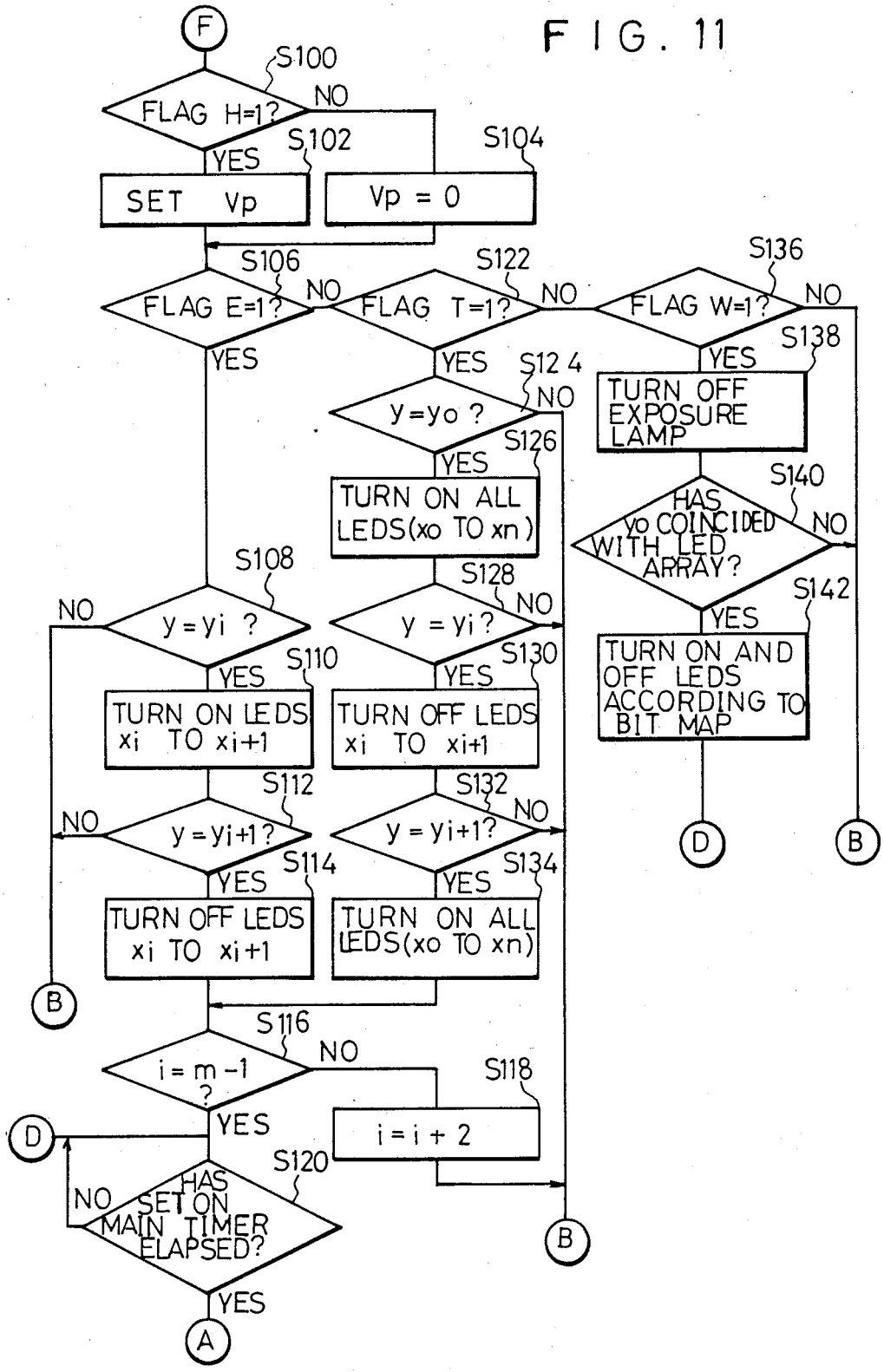

FIG. 7 is a circuit diagram of a driving and controlling circuit for driving and controlling the latent image eraser 4. The driving and controlling circuit comprises a shift register 401, a latch 402 and a driver 403, which are controlled by control signals transmitted to the driving and controlling circuit from the second CPU 22 to turn on and off the driving transistors Tr(0) to Tr(N+47).

An output voltage Vout of the voltage regulator 921 is applied to drive the LED's (LED(0) to LED(N)). The level of the Vout is established by a control signal Vv received from the D/A converter 450.

(h) Operation:

The manner of operation of the copying machine embodying the present invention will be described hereinafter.

The first CPU 21 controls the copying operation at a density established by means of image density setting keys 853 and 854, for the number of times established by inputting numerals though the ten-key pad 850. The detail of the control operation is disclosed in U.S. Pat. No. 4,543,643 and hence the description thereof will be omitted.

The detail of the control operation by the second CPU 22 is shwon in FIGS. 8 to 11.

Referring to FIGS. 8 to 11, the second CPU 22 starts a routine when the power is turned on. First, the second CPU 22 initializes the copying machine in step S1. For example, the first address of the RAM 23 for storing the designated coordinate data is set as MA, the count "m" of a counter for counting the number of the designated coordinates is set as 0, the count "c" of a counter for counting the number of the designated coordinates for a designated are is set as 0, a suffix "i" for sorting the stored coordinate data in the ascending order of the y-axis coordinate values is set as 0, the count "J" of a counter for counting the number of font pattern readings is set as 0. Then, flags are set as their initial values and memories are cleared. And then, the main timer for regulating a time for one routine operation is set in step S3, and the input and output ports are activated in step S5.

Then, in step S7, an end flag En is decided whether coordinate values and light intensity have been designated for a designated area, or whether font patterns have been designated. If the end flag is not set as "1" in step S7, namely, if the input of coordinate value data, light intensity data, and font patterns have not yet been completed, operations of steps S17 to S72 will be executed.

In step S17, a decision is made whether a coordinate value data, (x, y), has been input. The decision is based on whether data input from the tablet 910 though the A/D converter 930 to the second CPU 22 has been varied. If the decision result in step S17 is YES, the routine advances to step S19, where a flag W, which is set in step S62 (this step will be described later), is decided. If the flag W is "1", the current operation mode is regarded as the character input mode, and operations of steps S21 to S27 will be executed. If the flag W is "0", the current mode is regarded as the coordinate value data input mode, and operations of steps S29 to S41 are executed.

In step S21 a decision is made whether the count "J" indicating the the number of font pattern readings is decided whether it is less than eight. If the count "J" is less than eight in step S21, the routine goes to step S23, where the said input electric signals are converted into character read signals to read font patterns from the RAM 23 (FIG. 12), and then, in step S25, a bit map for turning on and off the latent image eraser 4 is drawn in the RAM 23. Then, in step S27, the count "J" is increased by one, and then the routine returns to step S3. The upper limit value of the count "J", i.e., eight (8), is dependent on the number of the smaller LED's of 1 mm arranged and the five of the lateral dots of the dot matrix for expressing a character.

Figure 13:
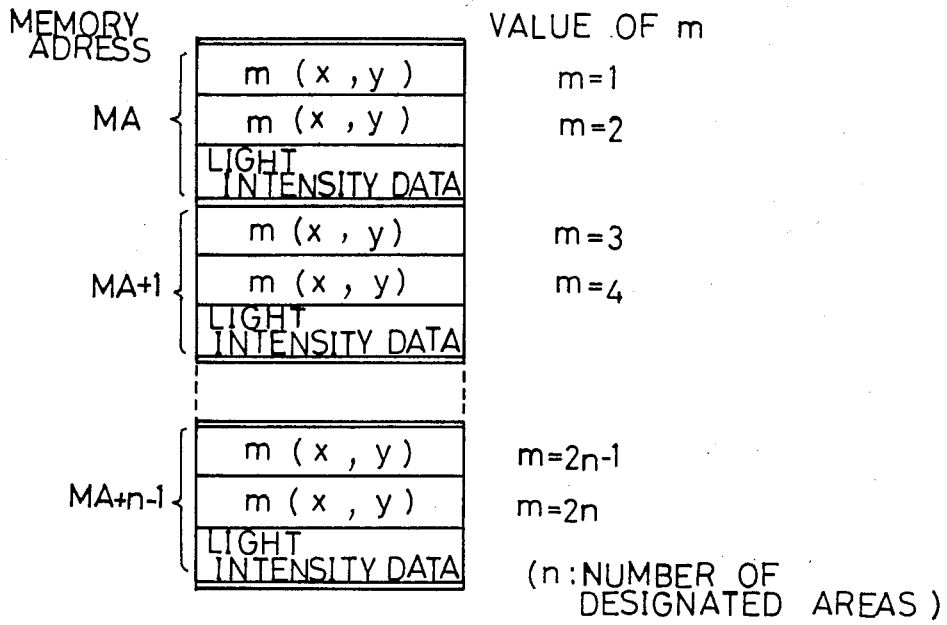
FIG. 13 is an illustration of a memory map explaining how data of coordinate values and light intensity are stored in a RAM.
Figure 14:
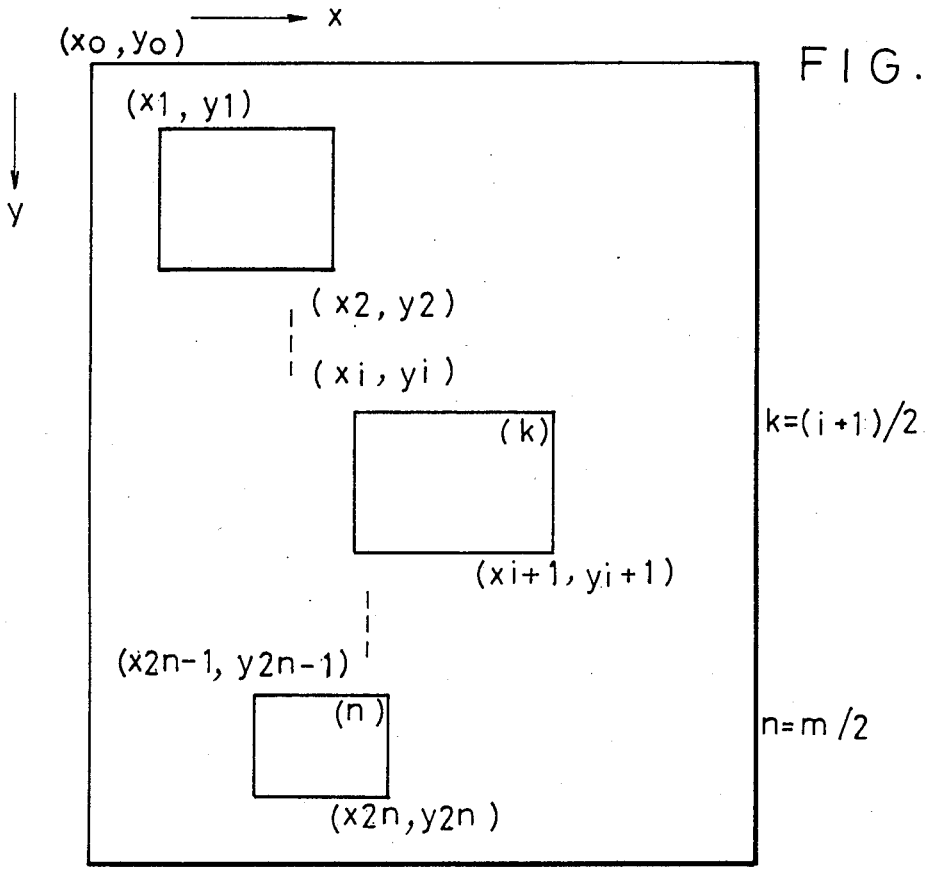
FIG. 14 is an illustration explaining relationships between a designated area and a data of the coordinate values.

If the flag W is "0" in step S19, the routine goes to step S29, where the count "m", the sum of the number of the designated coordinates is increased by one. The coordinate value data (x, y), which has been input at the "m" the input to the second CPU, is stored in the memory address MA of the RAM 23 in step S31. Then, the count "c", the number of the designated coordinates for a designated area, is increased by one step S33. In this embodiment, the operation mentioned above are repeated two times, namely intil the count "c" becomes two, because areas are designated as rectangular areas which can be defined only by specifying two end points of the diagonal lines (refer to FIG. 14). If the count "c" is 2 in step S35, the coordinate value data input for one area has been completed, the routine goes to step S37, and set the count "c" as zero. Then, in step S39, the light intensity data which is loaded into the resister in step S55, which will be described later, is stored in the memory address MA of the RAM 23. Namely, a set of coordinate value data and light intensity data for one area is stored in the RAM 23. (refer to FIG. 13). After storing the set of data, the value of the memory address MA is increased by one in step S41, and the routine goes to step S72. On the other hand, if the coordinate value data, (x, y), has not been input in S17, the routine goes to step S43.

In step S43, a decision is made whether the erase key 901 has been pressed. If the decision result in step S43 is YES, a flag E (erase flag) is set as "1" in step S45, and then the routine returns to step S3. If the decision result in step S43 is NO, the routine goes to step S47.

In step S47, a decision is made whether the trimming key 902 has been pressed. If the decision result in step S47 is YES, a flag T (trimming flag) is set as "1" in step S49, and then the routine returns to step S3. If the decision result in step S47 is NO, the routine goes to step S51.

In step S51, a decision is made whether the half key 903 has been pressed. If the decision result in step S51 is YES, a flag H (half flag) is set as "1" in step S53, and then light intensity data is loaded into the register 23 in step S55. Said light intensity data is input into the first CPU 21 by pressing the function key 851 and ten key pad 850 of the copying machine. And then the light tensity data is transmitted to the second CPU 22 in step S200 (refer to FIG. 9). The routine returns to step S3 from step S55. If the decision result in step S51 is NO, the routine goes to step S60 (refer to FIG. 10).

In step S60, a decision is made whether the character mode key 905 has been pressed. If the decision result in step S60 is YES, the flag W (character mode flag) is as "1" in step S62 to establish the character mode. If the decision result is NO, the routine goes to step S64.

In step S64, a decision is made whether the clear key 904 has been pressed. If the decision result in step S64 is YES, the coordinate value data and the light intensity data for one designated area stored in the memory address MA of RAM 23 are cleard in step S66. On the other hand, if the decision result in step S64 is NO, the routine goes to step S68.

In step S68, a decision is made whether the end key 906 has been pressed. If the decision result in step S68 is YES, a flag En (end flag) is set as "1" in step S70. If the decision result in step S68 is NO, the routine goes to step 72, where a decision is made whether the all clear key 907 has been pressed. If the decision result in step S72 is YES, the routine returns to step S1, while the routine returns to step S3 if the decision result in step S72 is NO.

Said flag En is decided in step 7. If it is found that the end flag En has been set as "1" in step S7, in other word, if it is found that inputting of the coordinate value data, the light intensity data and the character has been completed, the routine goes to step S9, where a decision is made whether the copying is in operation. If the decision result in step S9 is NO, the routine goes to step S72. If the decision result in step S9 is YES, the set of stored data, i.e., the set of the coordinate value data and the light intensity data stored in the RAM 23, is sorted in the ascending order of the y-axis coordinate values, namely, the y-axis coordinate value of the upper left point of the $\{(i+1)/2\}$th area with respect to a scanning direction is taken as $Y_i$; and the suffix "i" starts from 1 in step S15.

The routine goes to step S100, where a decision is made whether said half flag H has been set as "1" or "0" for the $\{(i+1)/2\}$th area with respect to a scanning direction. If the half flag H is "1" in step S100, the routine goes to step S102, where the light intensity data for the $\{(i+1)/2\}$th area with respect to a scanning direction is applied to the voltage regulator 921. If the half flag H is "0" in step 100, the routine goes to step S104, where the light intensity data is set to the level of full erasing. The routine goes to step S106 and later steps from step S102 or S104.

In steps S106 to S114, the light intensity data for the $\{(i+1)/2\}$th area with respect to the scanning direction is either full-erased or half-erased. The LED's are turned on to full-erase or half-erase the rectangular area having a diagonal lines defined by coordinate values $(X_i, Y_i)$ and $(x_{i+1}, Y_{i+1})$.

On the other hand, in steps S122 to S134, the $\{(i+1)/2\}$th area with respect to the scanning direction is either trimmed or half-trimmed. The LED's are turned off to full-erase or half-erase an area outside the rectangular area having the diagonal line defined by the coordinate values $(x_i, Y_i)$ and $(x_{i+1}, Y_{i+1})$. Said operations are repeated until the suffix "i" is increased by two until it reaches a values $m-1$ in step S116. And the routine returns to step S1 after the main timer has counted up in step 120.

In steps S136 to S142, the smaller LED's of the latent image eraser 4, LED $(N+1)$ to LED $(N+47)$, are independently turned on and off according to the bit map stored in the RAM 23, and the charges on the photosensitive drum 61 are eliminated so as to form desired character patterns. The LED's turning on and off starts when a LED coincide with y-axis coordinate value $Y_n$. Thus said character pattern is entered in copying papers.

In the foregoing embodiment, the character pattern is entered when the LED coincide with y-axis coordinate value $Y_n$. To put it differently, the character pattern is entered in a single position on the copying paper. It is also possible to enter characters in a plurality of positions on the copying paper by storing and outputting the character data and the coordinate value data in a set.

Furthermore, the upper limit of the number of characters is not limited to eight.

Still further, the description of the foregoing embodiment has not referred to varying the copying magnification, however, it is possible to combine the present invention with a known magnification changing means.

As apparent from the foregoing description, the copying machine according to the present invention is capable of designating the coordinate values and entering characters. Accordingly, desired data can be printed on a copying paper.

Furthermore, desired data can be readily entered in a copying paper without a word processor keyboard which requires significant modifications on the copying system.

Still further, the copying machine according to the present invention, which employs an electrophotographic process for reproducing an image of a document, is capable of designating a plurality of areas in a copying paper and half erasing the areas at designated density. Thus the designated area can be highlightened depending on their degrees of importance because the designated areas are half-erased at designated density to set reproduced image to desired density.

Having now fully described the invention, it will be apparent to one of ordinary skill in the art that many changes and modifications can be made thereto without departing from the spirit or scope of the invention as set forth herein.

What is claimed is:

1. A copying machine comprising:

a photosensitive member;

first exposure means for projecting an optical image of a document on the surface of said photosensitive member, second exposure means for irradiating the surface of said photosensitive member, said second exposure means comprising a plurality of light emitting elements which are driven selectively for light emission;

signal generating means for generating a plurality of different signals;

mode selecting means for selecting either a first mode in which the signal generated by said signal generating means is used for designating an area on the document to be copied or a second mode in which the signal generated by said signal generating means is used for designating a character;

area designating means for designating the area on the document to be copied on the basis of the signal generated by said signal generating means in the first mode;

character designating means for designating the character on the basis of the signal generated by said signal generating means in the second mode;

first control means for controlling said first exposure means so as to project the optical image of entire area of the document on the surface of said photosensitive member and for controlling said second exposure means so as to irradiate the surface of said photosensitive member corresponding to an area outside the area designated by said area designating means in said first mode; and second control means for controlling said first exposure means so as to release the function thereof and for controlling said second exposure means so as to project an optical image of the character designated by said character designating means in said second mode.

2. A copying machine as recited in claim 1, wherein said signal generating means comprises a plurality of switches.

3. A copying machine as recited in claim 1, wherein said area designating means designates a particular area by four signals.

4. A copying machine as recited in claim 1, wherein said character designating means designates one character by one signal.

5. A copying machine comprising;

a tablet for supporting a document thereon;

signal generating means for generating electric signals representing predetermined positions on the surface of said tablet when said positions are pressed;

a font memory for storing predetermined character pattern information;

an input mode selecting key for selecting a coordinate value input mode or a character input mode;

a signal converting unit for converting said electric signals into coordinate value signals in the coordinate value input mode, and for converting said electric signals into character reading signals representing said character pattern information stored in said font memory in the character input mode;

copying means for copying an image of the document in an area designated by said coordinate value signals on a copying paper; and character entering means for entering characters designated by said character reading signal on the copying paper.

6. A copying machine comprising:

first density designating means for designating a general copied image density of a document;

area designating means for designating a particular area of the document;

second density designating means for designating a copied image density, which is different from the general copied density designated by the first density designating means, for the particular area of the document designated by said area designating means; and copying means for copying the particular area of the document in the copied image density designated by said second density designating means and for copying an area outside the particular area of the document in the general density designated by said first density designating means.

7. A copying machine as recited in claim 6, wherein said second density designated means designates a copied image density lower than the general copied image density designated by said first density designating means.

8. A copying machine as recited in claim 6, wherein said second density designated means is a ten-key which sets number of copies to be produced.

9. A copying machine comprising:

first density designating means for designating a general copied image density of a document;

area designating means for designating a plurarity of particular areas of the document;

second density designating means for designating copied image density, which are different from the general copied image density designated by the first density designating means, for the plurarity of particular areas of the document designated by said area designating means; and copying means for copying the particular areas of the document in the copied image density designated by said second density designating means and for copying a area outside the particular area of the document in the general density designated by said first density designating means.

10. A copying machine as recited in claim 9, wherein said second density designating means is capable of designating different copied image density for different particular areas of the document.

11. A copying machine as recited in claim 9, wherein said second density designating means is a ten-key which sets number of copies to be produced.

12. A copying machine which forms an electrostatic latent image on a charged photosensitive member by exposing said charged photosensitive member to an optical image of a document, develops the electrostatic latent image by means of a toner to form a toner image, and transfers the toner image to a copying paper, comprising:

area designating means for designating a plurality of areas in said document;

potential designating means for designating levels of potential to which the respective potentials of area on said photosensitive member corresponding to the plurality of designated areas in the document are to be reduced, respectively;

memory means for storing the levels of potential to which the respective potentials of said areas are to be reduced, respectively, on the basis of the signals provided by said area designating means and said potential designating means; and potential reducing means for reducing the respective potentials of said areas on said photosensitive member to the designated levels, respectively, on the basis of signals provided by said memory means, prior to developing said electrostatic latent image.

13. A copying machine which forms an electrostatic latent image on a charged photosensitive member by exposing the charged photosensitive member to an optical image of a document, develops the electrostatic latent image by means of a toner to form a toner image, and transfers the toner image to a copying paper, comprising:

area designating means for designating a particular area in said document;

potential designating means for designating a level of potential to which the potential of an area on said photosensitive member corresponding to the designated area of said document is to be reduced; and potential reducing means for reducing the potential of said area on said photosensitive member to the designated level on the basis of signals provided by said area designating means and said potential designating means, prior to developing said electrostatic latent image.

* * * * *